United States Patent [19]

de Vrieze et al.

[11] Patent Number: 5,068,568

[45] **Date of Patent: * Nov. 26, 1991**

[54] CATHODE RAY TUBE HAVING MULTILAYER INTERFERENCE FILTER

[75] Inventors: Henricus M. de Vrieze; Johannes H. J. Roosen; Leendert Vriens, all of Eindhoven, Netherlands

[73] Assignee: U.S. Philips Corporation, New York, N.Y.

[ * ] Notice: The portion of the term of this patent subsequent to Jan. 6, 2004 has been disclaimed.

[21] Appl. No.: 524,718

[22] Filed: May 15, 1990

Related U.S. Application Data

[63] Continuation of Ser. No. 14,566, Feb. 13, 1987, abandoned, which is a continuation-in-part of Ser. No. 742,834, Jun. 10, 1985, Pat. No. 4,647,812, which is a continuation-in-part of Ser. No. 662,311, Oct. 18, 1984, Pat. No. 4,634,926.

[30] Foreign Application Priority Data

May 21, 1986 [GB] United Kingdom ..... 8612358

[51] Int. Cl.[5] ..... H01J 29/10

[52] U.S. Cl. ..... 313/474; 313/112

[58] Field of Search ..... 313/112, 473, 474, 478, 313/480; 350/1.6, 164; 358/250, 253

[56] References Cited

U.S. PATENT DOCUMENTS

| | | | |
|---|---|---|---|
| 4,065,696 | 12/1977 | Steierman | 313/480 |
| 4,310,783 | 1/1982 | Temple et al. | 313/474 |
| 4,634,926 | 1/1987 | Vriens et al. | 313/474 |
| 4,683,398 | 7/1987 | Vriens et al. | 313/112 X |

FOREIGN PATENT DOCUMENTS

| | | | |
|---|---|---|---|
| 2176048 | 12/1986 | United Kingdom | 313/474 |

OTHER PUBLICATIONS

Chem. Abstracts; Pawlewicz et al, "Reactively Sputtered Optical Coatings for Use at 1064 nm", 93:158673b.

*Primary Examiner*—Sandra L. O'Shea
*Attorney, Agent, or Firm*—John C. Fox

[57] ABSTRACT

A cathode ray tube, such as a projection cathode ray tube, having a multilayer interference filter disposed between the cathodoluminescent screen and the interior side of the faceplate, the interference filter comprising alternate layers having high (H) and low (L) refractive indices, the high refractive index material being niobium pentoxide and the low refractive index material being either silicon oxide or magnesium fluoride. These filters are substantially free from the crazing which occurs in known filters when subjected to the normal thermal processing of cathode ray tubes.

27 Claims, 2 Drawing Sheets

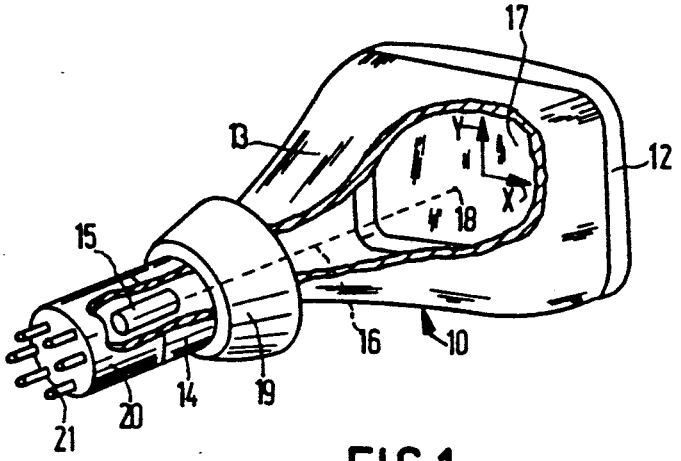
FIG.1
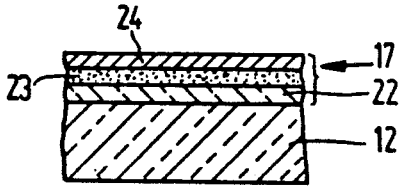
FIG. 2
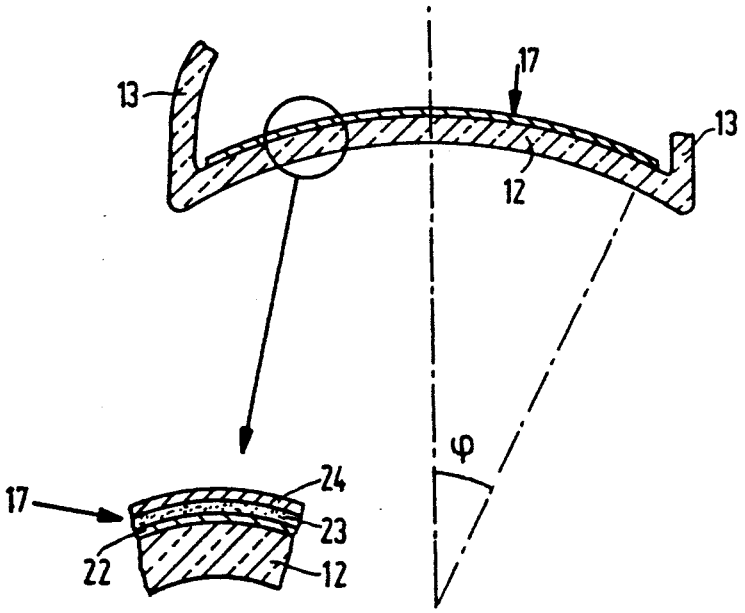
FIG.3A
FIG.3

CATHODE RAY TUBE HAVING MULTILAYER INTERFERENCE FILTER

This is a continuation of application Ser. No. 07/014,566 filed Feb. 13, 1987now abandoned, which is a continuation-in-part of application Ser. No. 742,834, filed June 10, 1985, now U.S. Pat. No. 4,647,812, which is a continuation-in-part of application Ser. No. 662,311, filed Oct. 18, 1984, now U.S. Pat. No. 4,634,926.

BACKGROUND OF THE INVENTION

The present invention relates to a method of manufacturing cathode ray tubes and to cathode ray tubes made by the method, the cathode ray tubes having a multilayer interferenece filter disposed between the cathodoluminescent display screen and the interior side of the faceplate. Such cathode ray tubes may comprise projection television tubes.

The present invention also relates to a projection television system comprising three cathode ray tubes having cathodoluminescent screens luminescing in different colours, wherein at least one of said cathode ray tubes comprises a tube made in accordance with the present invention.

A multilayer interference filter comprises a number of layers manufactured alternately from a material having a high refractive index and a material having a low refractive index. Projection display tubes including such multilayer interference filters are disclosed in European Patent Publication 0170320 (PHN 11.106), unpublished Netherlands Patent Application 8502226 (PHN 11.460) and unpublished British Patent Application 8513558 (PHQ 85.007). Typically the alternate layers may comprise in the case of a low refractive index material $SiO_2$ (refractive index n=1.47) or $MgF_2$ (n=1.38) and in the case of a high refractive index material $TiO_2$ (n=2.35) or $Ta_2O_5$ (n=2.00) the precise value of n being dependent on the substrate temperature during evaporation and also on the annealing cycle after evaporation. These known multilayer filters comprise at least six but more typically at least fourteen layers alternately made from the respective high and low refractive index materials. The layers have an optical thickness nd, where n is the refractive index of the material of the layer and d is the thickness, the optical thickness nd of the individual layers being between $0.2\lambda_f$ and $0.3\lambda_f$, where $\lambda_f$ is equal to $p\times\lambda$, and $\lambda$ is the desired central wavelength selected from the spectrum emitted by the luminescent material of the relevant display screen, and p is a number between 1.18 and 1.32 for curved faceplates and between 1.18 and 1.36 for flat faceplates. The average optical thickness throughout the stack, excluding possible outer terminating 0.125 $\lambda_f$ layers, is $0.25\lambda_f$ and $\lambda_f$ is the central wavelength of the filter. Although these so-called shortwave pass multilayer interference filters perform reasonably satisfactorily, further investigation has shown that the filters can suffer from crazing (formation of cracks) after the tube processing is completed. The crazing manifests itself, subsequent to the evaporation of the filter layers, after tube processing which includes temperature cycles up to 400° to 460° C. Such crazing reduces the quality of the optical performance of the multilayer interference filter.

A letter entitled "Observation of Exceptional Temperature Humidity in Multilayer Filter Coatings" by Peter Martin, Walter Pawlewicz, David Coult and Joseph Jones, published in Applied Optics, Vol. 23, No. 9, May 1, 1984, pages 1307 and 1308, discloses multilayer filter coatings made by reactive sputtering techniques using $Si_3N_4/SiO_2$ and $Nb_2O_5/SiO_2$ as the high and low refractive-index layers. The design of the $Si_3N_4/SiO_2$ filter was $LL(HL)^{14}HLL$ where L and H represent a quarterwave optical thickness of low-and high-refractive index material, respectively, whereas the design of the $Nb_2O_5/SiO_2$ filter was $LL(HL)^{10}LL$. This letter reports that temperature and relative humidity testing with temperatures in the range of 75° C. to 140° C. and relative humidities between 0 and 85% indicated that as far as transmittance in the sidebands is concerned, a $Si_3N_4/SiO_2$ coating was remarkably more stable than a $Nb_2O_5/SiO_2$ coating. This letter does not provide details of how each multilayer filter is made, especially the nature of the substrates, the deposition temperatures and subsequent processing of the filter, all of which have some bearing on the crazing, the quality of bonding between, and the hardness of, the layers and the actual refractive indices of the material. Furthermore the authors of this letter have not addressed themselves to the provision of interference filters in cathode ray tubes where the problems are different because amongst other things: 1. the much higher temperatures, above 400° C., used in tube processing (crazing has been found to be initiated above about 330° C.); and 2. the electron bombardment during tube operation.

An object of the present invention is to reduce and preferably avoid crazing in multilayer interference filters used in cathode ray tubes.

Another object of the present invention is to reduce the cycle time for filter evaporation.

According to a first aspect of the present invention there is provided a method of making a cathode ray tube having a multilayer interference filter provided on an internally facing surface of a faceplate, the method including the step of depositing alternate layers of a material having a relatively high refractive index and a material having a relatively low refractive index on the faceplate, the material having a relatively high refractive index comprising niobium pentoxide.

According to a second aspect of the present invention there is provided a cathode ray tube having a faceplate, a cathodoluminescent screen and a multilayer interference filter disposed between the faceplate and the screen, the filter comprising alternate layers of a material having a relatively high refractive index and a material having a relatively low refractive index deposited on the faceplate, wherein the material having a relatively high refractive index comprises niobium pentoxide.

The advantages of using niobium pentoxide compared with titanium dioxide are firstly that it can be evaporated at a much lower temperature, 80° C. for niobium pentoxide as compared to 300° C. for titanium dioxide, which reduces the cycle time by about a factor of two, and secondly that the resulting filters with niobium pentoxide are more resistant to crazing when subjected to a heating cycle including temperatures up to 400° to 460° C., which heating cycle is necessary in processing the completed faceplate.

When titanium dioxide is evaporated at lower temperatures the oxidation is slowed down appreciably, resulting in either not fully oxidized and therefore light absorbing layers or unacceptably long evaporation times and lower refractive indices of the layers. Niobium pentoxide can be evaporated with a high rate at a temperature as low as 80° C., yielding layers with a high refractive index. Such a high rate of evaporation of niobium pentoxide at 80° C. reduces the cycle time for filter evaporation.

The advantages of using niobium pentoxide compared with tantalum pentoxide are firstly that niobium pentoxide has a substantially higher refractive index, yielding filters with a much broader reflection band, and secondly that the interference filters with niobium pentoxide are more resistant to crazing when subjected to the heating cycle including temperatures of up to 400° to 460° C.

One embodiment of a filter comprised niobium pentoxide as the high refractive index material and silicon dioxide as the low refractive index material. 20-layer $Nb_2O_5/SiO_2$ filters evaporated with substrate temperatures of 80°, 200° and 300° C., had little or no crazing after being heated to temperatures of 460° C. The reason for this unexpected result is that tests with: (1) 20 layer $TiO_2/SiO_2$ filters evaporated with substrate temperatures of 300° and 400° C., (2) 20 layer $Ta_2O_5/SiO_2$ filters evaporated with substrate temperatures of 80° and 200° C., and (3) $(10/4)\lambda_f$ $SiO_2$ layers, that is layers having an equivalent thickness of $SiO_2$ as in the filters in (1) and (2) above, evaporated also with different substrate temperatures, all showed more and a mutually very similar amount of crazing when subjected to the same temperature cycling with temperatures of up to 460° C. Interleaving silicon dioxide with niobium pentoxide reduces the occurrence of crazing, in some cases even to such an extent that it no longer occurs. These comparative tests were performed using as substrate material, projection television faceplate glass having an expansion coefficient of $95\times10^{-7}$.

In another embodiment the filter comprised niobium pentoxide as the high refractive index material and magnesium fluoride, as the low refractive index material. 20-layer filters of these materials evaporated with substrate temperatures of 200° and 300° C. did not show any crazing.

The cathode ray tube made in accordance with the present invention may comprise at least 9 layers, typically between 14 and 30 layers, each layer having an optical thickness nd, where n is the refractive index of the material, d is the thickness. The optical thickness nd is chosen to lie between $0.2\lambda_f$ and $0.3\lambda_f$, more particularly between $0.23\lambda_f$ and $0.27\lambda_f$, with an average optical thickness $0.25\lambda_f$, where $\lambda_f$ is equal to $p\times\lambda$, where $\lambda$ is the desired central wavelength selected from the spectrum emitted by the cathodoluminescent screen material and p is a number between 1.20 and 1.33.

The faceplate may comprise a mixed-alkali glass substantially free of lead oxide having a coefficient of expansion in the range from $85\times10^{-7}$ to $105\times10^{-7}$ per degree C. for temperatures between 0° and 400° C. The main components in weight percent of such a glass may be

| | |
|---|---|
| $SiO_2$ | 50 to 65 |
| $Al_2O_3$ | 0 to 4 |
| BaO | 0,5 to 15 |
| SrO | 8 to 22 |
| $K_2O$ | 3 to 11 |
| $Na_2O$ | 3 to 9 |
| $Li_2O$ | 0 to 4 |

with the restrictions that (1) BaO and SrO together lie between 16 and 24, and (2) the combination formed by $Li_2O$, $Na_2O$ and $K_2O$ lie between 14 and 17.

BRIEF DESCRIPTION OF THE DRAWINGS

The present invention will now be described, by way of example, with reference to the accompanying drawings, wherein:

FIG. 1 is a diagrammatic perspective view of a projection cathode ray tube with a portion of its envelope broken away, FIG. 2 is a diagrammatic cross-section through a portion of a flat flaceplate, FIG. 3 is a diagrammatic cross-section through a curved faceplate of a display tube, FIG. 3A is the circled portion of the faceplate of FIG. 3 shown enlarged.

DESCRIPTION OF THE PREFERRED EMBODIMENT

Figure 4:
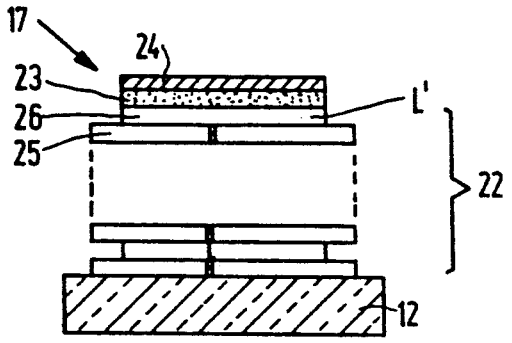
FIG. 4 is a diagrammatic cross-section through a short wave pass multilayer interference filter.

In the drawings the same reference numerals have been used to indicate corresponding features.

The projection cathode ray tube 10 shown in FIG. 1 comprises a glass envelope formed by a faceplate 12, a cone 13 and a neck 14. An electron gun 15 is provided in the neck 14 and generates an electron beam 16 which produces a spot 18 on a cathodoluminescent screen structure 17 provided on the faceplate 12. The spot 18 is deflected in mutually perpendicular directions X and Y by deflection coils 19 mounted at the neck-cone transition of the envelope. Electrical connections to the interior of the envelope are via pins 21 in a cap 20.

The tube 10 shown in FIG. 1 has a flat faceplate 12 and a portion of the faceplate 12 and screen structure 17 are shown in FIG. 2. The screen structure 17 comprises a multilayer short wave pass interference filter 22 applied to the interior surface of the faceplate, a cathodoluminescent screen material 23 applied to the filter 22 and an aluminium film 24 covering the screen material 23. The detailed construction of the filter 22 will be described later with reference to FIG. 4.

FIG. 3 shows another embodiment of a projection television cathode ray tube in which at least the inside surface, but more conveniently both surfaces of the faceplate 12, are convex as viewed from the interior of the envelope. The convex surfaces may be part-spherical, having a radius of curvature between 150 mm and 730 mm. The angle of curvature $\Phi$, defined as the angle between the optical axis and a normal to the interior convex surface at a point furthest from the centre of the screen, has a maximum angle of 18°. The structure 17 of the screen, shown enlarged in FIG. 3A, is as described with reference to FIG. 2.

Referring now to FIG. 4, the multilayer interference filter 22 comprises at least 9, but typically between 14 and 30, layers with alternate layers having (H) and low (L) refractive indices (n). The optical thickness of each of the layers is n.d, where n is the refractive index of the material and d the actual layer thickness, the optical thickness for the individual layers lies between $0.2\lambda_f$ and $0.3\lambda_f$, more particularly between $0.23\lambda_f$ and $0.27\lambda_f$ with an average optical thickness throughout the stack of $0.25\lambda_f$, where $\lambda_f$ is equal to $p\times\lambda$, p being a number between 1.20 and 1.33 and λ being the desired central wavelength selected from the spectrum emitted by the cathodoluminescent screen 23. In fabricating the filter 22 the high refractive index layer 25 furthest from the faceplate has an optical thickness in the range specified, but this layer 25 may be covered by a thinner, typically $0.125\lambda_f$, terminating layer 26 having a lower (L') refractive index.

As is apparent from the foregoing description the value of the optical thickness is dependent on the value assigned p and λ. By way of example, when the screen material comprises a terbium activated substantially green luminescing phosphor having λ=545 nm, p has a value between 1.20 and 1.26. A red phosphor material such as europium-activated yttrium oxide ($Y_2O_3$:EU) has λ=612 nm and p has a value between 1.20 and 1.26. Finally a blue phosphor material such as zinc sulphide-silver (ZnS:Ag) has λ=460 nm and p has a value between 1.24 and 1.33.

The optical thicknesses of a typical multilayer $(HL)^9H$ filter with an optional terminating layer is as shown in the following tabular summary:

| Layer No. | | n | $n.d/\lambda_f$ |
|---|---|---|---|
| Phosphor | | | |
| 1 | (Terminating Layer) | L | 0.131 |
| 2 | | H | 0.260 |
| 3 | | L | 0.257 |
| 4 | | H | 0.254 |
| 5 | | L | 0.251 |
| 6 | | H | 0.249 |
| 7 | | L | 0.247 |
| 8 | | H | 0.246 |
| 9 | | L | 0.245 |
| 10 | | H | 0.245 |
| 11 | | L | 0.244 |
| 12 | | H | 0.245 |
| 13 | | L | 0.245 |
| 14 | | H | 0.246 |
| 15 | | L | 0.247 |
| 16 | | H | 0.249 |
| 17 | | L | 0.251 |
| 18 | | H | 0.254 |
| 19 | | L | 0.257 |
| 20 | | H | 0.260 |
| Faceplate | | 1.57 | |

The multilayer filter 22 is manufactured by depositing, for example by evaporation or sputtering, the high and low refractive index materials on a suitably prepared faceplate 12 which acts as a substrate. In one example the high refractive index material is niobium pentoxide ($Nb_2O_5$) and the low refractive index material is silicon dioxide ($SiO_2$). In another example niobium pentoxide is used with magnesium fluoride ($MgF_2$) as the low refractive index material. Previously interference filters have been made using titanium pentoxide as the high refractive index material and silicon dioxide as the low refractive index material which have been evaporated onto a substrate at temperatures of the order of 300° to 400° C. Such filters although having good optical characteristics and bonding between adjacent layers were found to suffer from crazing after the subsequent tube processing steps including sedimentation of the phosphor material, lacquering, evaporation of the aluminium film over the phosphor/lacquer combination and heating to over 400° C. to evaporate the lacquer and to get a good vacuum in the tube. Moreover, the cycle time required for the deposition is quite large due to the high substrate temperature needed for the evaporation of $TiO_2$.

Figure 5:
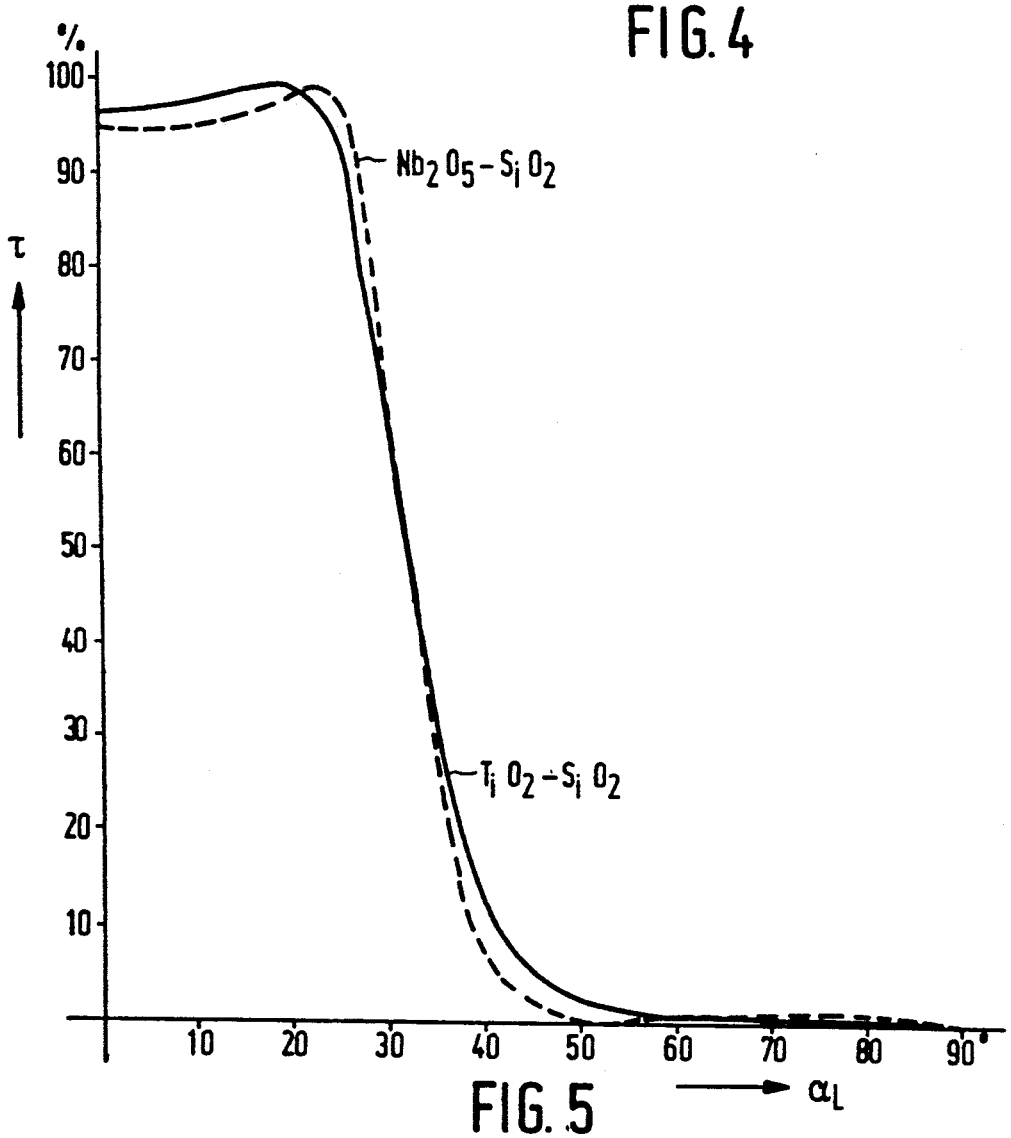
FIG. 5 is a graph showing the short wave pass characteristics of a known 20 layer $TiO_2$—$SiO_2$ filter (continuous line) including an $0.125\lambda_f$ terminating layer, and of a 19 layer $Nb_2O_5$—$SiO_2$ filter (broken line) without a terminating layer; the ordinate representing transmittance $\tau$ and the abscissa the angle $X_L$ in degrees.

The problem of crazing has been almost completely overcome by using niobium pentoxide evaporated preferably onto a cool substrate at typically 80° C., although higher temperature substrates can also be used. Niobium pentoxide deposited in the whole temperature range from 80° C. to 300° C. has been found to have a high refractive index and when used with silicon dioxide the difference in refractive indices between them is large enough to get a sufficiently wide reflection band, that is a difference almost as large as that using titanium dioxide as shown in FIG. 5. In FIG. 5 light incident on the filter at $X_L$ angles up to 32° is transmitted whereas light incident at greater angles is reflected, that is, its transmittance $\tau$ decreases to substantially zero. In consequence a bright substantially haze-free image is obtained, with an improved luminosity (by typically a factor of 1.5 to 1.9), a more saturated colour (particularly cathode ray tubes provided with green terbium activated phosphors and with a blue zinc sulphide-silver phosphor) leading to substantially less chromatic aberration when used in a projection television system, and improved contrast.

In the case of using magnesium fluoride as the low refractive index material it is necessary to do the evaporation of niobium pentoxide and magnesium fluoride at temperatures of the order of 200° C. to 300° C. to ensure that the layers have the required degree of hardness and bond well to each other and to the substrate. When using 300° C., the hardness of the layers is greater than when using 200° C.

Factors which are considered to have contributed to the crazing include: (1) the fact that the substrates, that is the faceplates, have a large coefficient of expansion, that is lying in the range $85\times10^{-7}$ to $105\times10^{-7}$ per degree C. for temperatures between 0° C. and 400° C. In contrast to, in particular silicon dioxide has a small coefficient of expansion; (2) the fact that a large number of layers, typically of the order of 20 layers, have been used (crazing is enhanced when the number of layers is increased and it is reduced when the number of layers is decreased); (3) the fact that the filters have usually been annealed some time (one or more days) after evaporation (allowing the substrate to cool to ambient temperature before annealing and thus allowing the water vapour to penetrate into the pores of the filter has been found to encourage crazing); It is believed that niobium pentoxide enhances the overall elasticity of the multilayer filters to some extent thus reducing the crazing. In recent experiments $Nb_2O_5$—$SiO_2$ filters evaporated at substrate temperatures from 80° C. to 300° C. and $Nb_2O_5$—$MgF_2$ filters evaporated at temperatures from 200° C. and 300° C. were annealed at 460° C. substantially immediately after evaporation without any cooling-off of the substrate. This completely eliminated the occurrence of crazing for these filters.

A suitable glass for a substrate for a cathode ray tube, in particular for projection television is a mixed-alkali glass free or almost free of lead oxide (PbO) and containing barium oxide (BaO) and strontium oxide (SrO) as the main X-ray absorbers.

The compositions in weight per cent of suitable existing glasses to use as substrates are as follows:

| components | Manufacturer/Type | | |
|---|---|---|---|
| | Schott S8010 | Nippon Electric Glass | Asahi |
| $SiO_2$ | 57.2 | 56 | 60 |
| $Al_2O_3$ | 0.2 | 3.0 | 2.1 |
| BaO | 0.5 | 12.00 | 8.2 |
| SrO | 21.3 | 11.00 | 10.1 |
| $K_2O$ | 3.1 | 10.00 | 8.3 |
| $Na_2O$ | 8.8 | 5.00 | 5.6 |
| $Li_2O$ | 3.0 | 1.00 | 1.5 |
| CaO | 0.06 | 0.08 | 2.00 |
| $CeO_2$ | 0.3 | 0.50 | 0.6 |
| $Sb_2O_3$ | 0.2 | 0.50 | 0.2 |
| $TiO_2$ | 0 | 0.60 | 0.4 |
| ZnO | 3.0 | 0 | 0 |
| $ZrO_2$ | 0.3 | 0.1 | 1.0 |
| Trace elements | 2.0 | 0 | 0 |

What is claimed is:

1. A method of making a multilayer interference filter provided on an internally facing surface of a faceplate of a cathode ray tube, the method comprising depositing alternate layers of a material having a relatively high refractive index and a material having a relatively low refractive index on the faceplate, the material having a relatively high refractive index comprising niobium pentoxide.

2. A method as claimed in claim 1, wherein at least 9 alternate layers are deposited, the layers having an optical thickness nd, where n is the refractive index of the materials and d is the thickness, the optical thickness nd of the individual layers being between $0.2\lambda_f$ and $0.3\lambda_f$, with an average optical thickness of the layers being $0.25\lambda_f$, where $\lambda_f$ is equal to $p\times\lambda$, where $\lambda$ is the desired central wavelength selected from the spectrum emitted by the cathodoluminescent screen material and p is a number between 1.20 and 1.33.

3. A method as claimed in claim 1, wherein the low refractive index material comprises silicon dioxide, and the alternate layers are deposited at a temperature in the range of substantially 80° C. to substantially 300° C.

4. A method as claimed in claim 1, wherein the low refractive index material comprises magnesium fluoride, and the alternate layers are deposited at a temperature in the range of substantially 200° C. to substantially 300° C.

5. A method as claimed in claim 1, wherein the multilayer interference filter is annealed whilst the faceplate is still at above ambient temperature.

6. A method as claimed in claim 1, wherein the faceplate comprises a mixed-alkali glass substantially free of lead oxide (PbO).

7. A method as claimed in claim 6, wherein the faceplate has a coefficient of expansion in the range $85\times10^{-7}$ to $105\times10^{-7}$ per degree centigrade for temperatures between 0° and 400° C.

8. A method as claimed in claim 7, wherein the glass composition in weight percent comprises as main components:

| | |
|---|---|
| $SiO_2$ | 50 to 65 |
| $Al_2O_3$ | 0 to 4 |
| BaO | 0.5 to 15 |
| SrO | 8 to 22 |
| $K_2O$ | 3 to 11 |
| $Na_2O$ | 3 to 9 |
| $Li_2O$ | 0 to 4 |

with the restrictions that (1) BaO and SrO together lie between 16 to 24, and (2) the combination formed by $Li_2O$, $Na_2O$ and $K_2O$ lie between 14 and 17.

9. A method as claimed in claim 1, in which a cathodoluminescent screen is provided on the interference filter.

10. A method as claimed in claim 2, in which the last layer of average optical thickness of $0.25\lambda_f$ of the filter comprises a material having a high refractive index, in which a terminating layer is provided on the last layer, the terminating layer having a lower refractive index than the last layer and a thickness of substantially less than an average optical thickness of $0.25\lambda_f$, and in which a cathodoluminescent screen is provided on the terminating layer.

11. A cathode ray tube having a faceplate, a cathodoluminescent screen and a multilayer interference filter disposed between the faceplate and the screen, the filter comprising alternate layers of a material having a relatively high refractive index and a material having a relatively low refractive index, wherein the material having a relatively high refractive index comprises niobium pentoxide.

12. A tube as claimed in claim 11, wherein the filter comprises at least 9 layers, the layers having an optical thickness nd, where n is the refractive index of the materials and d is the thickness, the optical thickness nd of the individual layers being between $0.2\lambda_f$ and $0.3\lambda_f$, with an average optical thickness of the layers being $0.25\lambda_f$, where $\lambda_f$ is equal to $p\times\lambda$, where $\lambda$ is the desired central wavelength selected from the spectrum emitted by the cathodoluminescent screen material and p is a number between 1.20 and 1.33.

13. A tube as claimed in claim 12, wherein the filter has between 14 to 30 layers.

14. A tube as claimed in claim 12, wherein nd is between $0.23\lambda_f$ and $0.27\lambda_f$.

15. A tube as claimed in claim 11, wherein the low refractive index material comprises silicon dioxide.

16. A tube as claimed in claim 11, wherein the low refractive index material comprises magnesium fluoride.

17. A tube as claimed in claim 11, wherein the filter has been annealed substantially immediately after the layers have been deposited.

18. A tube as claimed in claim 11, wherein the faceplate comprises a mixed-alkali glass substantially free of lead oxide (PbO).

19. A tube as claimed in claim 18, wherein the faceplate has a coefficient of expansion in the range $85\times10^{-7}$ to $105\times10^{-7}$ per degree centigrade for temperatures between 0° and 400° C.

20. A tube as claimed in claim 19, wherein the glass composition in weight percent comprises as main components:

| | |
|---|---|
| $SiO_2$ | 50 to 65 |
| $Al_2O_3$ | 0 to 4 |
| BaO | 0.5 to 15 |
| SrO | 8 to 22 |
| $K_2O$ | 3 to 11 |
| $Na_2O$ | 3 to 9 |
| $Li_2O$ | 0 to 4 |

with the restrictions that (1) BaO and SrO together lie between 16 to 24, and (2) the combination formed by $Li_2O$, $Na_2O$ and $K_2O$ lie between 14 and 17.

21. A tube as claimed in any one of claim 11, wherein the inside of the faceplate is convex with a maximum angle of curvature $\Phi=18°$, where $\Phi$ is the angle between the optical axis and a normal to the convex surface at a point furthest from the centre of the screen.

22. A tube as claimed in claim 21, wherein the convex faceplate is substantially spherical and has a radius of curvature between 150 mm and 730 mm.

23. A tube as claimed in claim 15 or 16, wherein the cathodoluminescent screen comprises a terbium activated substantially green luminescing phosphor having $\lambda=545$ nm and p is a number between 1.20 and 1.26.

24. A tube as claimed in claim 15 or 16, wherein the cathodoluminescent screen comprises a europium-activated yttrium oxide phosphor ($Y_2O_3$:Eu) having $\lambda=612$ nm and p is a number between 1.20 and 1.26.

25. A tube as claimed in claim 15 or 16, wherein the cathodoluminescent screen comprises a zinc sulphide-silver (ZnS:Ag) having $\lambda=460$ nm and p is a number between 1.24 and 1.33.

26. A tube as claimed in claim 12, wherein the average optical thickness of the layers is $0.25\lambda_f$, the layer furthest from the faceplate having a thickness of substantially $0.25\lambda_f$ comprises a material having a high refractive index, and wherein the layer furthest from the faceplate is covered by the cathodoluminescent material.

27. A tube as claimed in claim 26, wherein a terminating layer is disposed between the layer of high refractive index material furthest from the faceplate and the layer of cathodoluminescent screen material, the terminating layer having an optical thickness of substantially $0.125\lambda_f$ and being of a material having a lower refractive index than that of the adjacent filter layer.

* * * * *